United States Patent [19]

Aoki

[11] 4,351,040

[45] Sep. 21, 1982

[54] QUARTZ CRYSTAL WRISTWATCH

[75] Inventor: Shigeru Aoki, Suwa, Japan

[73] Assignee: Kabushiki Kaisha Suwa Seikosha, Tokyo, Japan

[21] Appl. No.: 150,262

[22] Filed: May 15, 1980

[30] Foreign Application Priority Data

May 16, 1979 [JP] Japan ..... 54-59949

[51] Int. Cl.[3] ..... G04C 23/02; G04B 19/02

[52] U.S. Cl. ..... 368/88; 368/220

[58] Field of Search ..... 368/76, 80, 88, 155–160, 368/187, 190, 191, 220, 223, 276, 299, 300, 316–318, 323

[56] References Cited

U.S. PATENT DOCUMENTS

| | | | |
|---|---|---|---|
| 3,492,808 | 2/1970 | Wuthrich | 368/323 |
| 3,611,702 | 10/1971 | Spadini | 368/252 |
| 3,676,993 | 7/1972 | Bergey et al. | 368/300 |
| 3,745,758 | 7/1973 | Kuritz | 368/157 |
| 4,177,631 | 12/1979 | Yamada et al. | 368/76 |
| 4,198,809 | 4/1980 | Miyasaka et al. | 368/80 |
| 4,243,329 | 1/1981 | Nakayama | 368/76 |
| 4,262,354 | 4/1981 | Sakamoto | 368/190 |

*Primary Examiner*—Vit W. Miska

*Attorney, Agent, or Firm*—Blum, Kaplan, Friedman, Silberman & Beran

[57] ABSTRACT

An improved quartz crystal wristwatch having an analog display and a reduced thickness is provided. The wristwatch includes a battery for powering a circuit and driving coil of a step motor for operating a gear train which are all arranged on a main plate so as not to overlap in plan view. The battery is disposed adjacent to a winding stem which is provided in the longitudinal direction of a diameter or line bisecting the main plate. A center wheel bridge is mounted on the main plate and a pillar-shaped member having a tubular region and a perpendicular disc-shape region is mounted in an opening in the center wheel bridge for supporting the cannon pinion which passes through the main plate about the tubular portion of the pillar-shaped member.

21 Claims, 13 Drawing Figures

QUARTZ CRYSTAL WRISTWATCH

BACKGROUND OF THE INVENTION

This invention relates to a quartz crystal wristwatch, and in particular to improved analog display quartz crystal wristwatches having reduced size and thickness.

The electronic quartz crystal wristwatches are increasing their share in the wristwatch market due in large part to their accuracy and reliability. To date, the demand for accuracy and reliability has been sufficiently satisfied. However, it is unfortunate that a small and thin quartz wristwatch having good after-sale servicability and a low price is desirable.

Accordingly, the present invention contemplates a solution to this problem and to provide a small and thin wristwatch which can be enjoyed more fully.

SUMMARY OF THE INVENTION

Generally speaking, in accordance with the invention, an analog display quartz crystal wristwatch wherein the gear train, battery, circuit and driving coil of the step motor are arranged so as not to overlap one another on the main plate in plan view is provided. The winding stem of the watch is disposed along a diameter of the movement or along a line bisecting a non-circular movement with the battery disposed adjacent to the winding stem. The battery, quartz oscillator, MOS-IC and the input terminal of the circuit are all arranged on one side of the winding stem with the output terminal to the step motor coil and watch setting assembly disposed on the opposed side of the winding stem.

The center wheel bridge is fixedly mounted to the main plate and a pillar-shaped member having a tubular region and a perpendicular disc-shaped region for mounting the pillar-shaped member is mounted on the center wheel bridge. The disc-shaped region includes a bearing surface for the fourth wheel and the tubular region passes through the main plate with a cannon pinion disposed thereabout. The step motor coil is positioned substantially parallel to the watch stem and a side-cut region in the case of a non-circular movement. The time indicating gear train is arranged in the central region of the movement with the setting assembly, converter, watch circuit and battery disposed about the periphery of the movement, respectively. Also, the time indicating and time setting gear trains are pivotally borne on a plurality of bridges.

Accordingly, it is an object of the invention to provide a improved analog display quartz crystal wristwatch.

Another object of the invention is to provide an improved quartz crystal wristwatch wherein the gear train, battery, circuit and step motor driving coil are each arranged on a main plate so as not to overlap one another in plan view.

The further object of the invention is to provide an improved quartz crystal wristwatch including a center wheel bridge fixedly mounted on the main plate.

Yet another object of the invention is to provide an improved quartz crystal wristwatch having a pillar-shaped member disposed between a center wheel bridge and main plate for supporting a cannon pinion which penetrates the main plate about the pillar-shaped member.

Still another object of the invention is to provide an improved quartz crystal wristwatch wherein the quartz crystal oscillator, MOS-IC, battery and imput terminal of the circuit are disposed on one side of a winding stem with the output terminal of the circuit, step motor coil and setting assembly are disposed on the opposed side of the winding stem.

Still a further object of the invention is to provide an improved quartz crystal wristwatch wherein the step motor coil is disposed in parallel with the winding stem and side-cut in the case of a substantially rectangular movement.

Another object of the invention is to provide an improved quartz crystal wristwatch wherein the time indicating gear train is provided at the central region of the movement with the setting assembly, step motor coil, circuit and battery arranged in order from the winding stem about the periphery of the main plate.

A further object of the invention is to provide an improved quartz crystal wristwatch construction wherein the time indicating gear train and setting gear train are pivotably born on a plurality of bridges.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
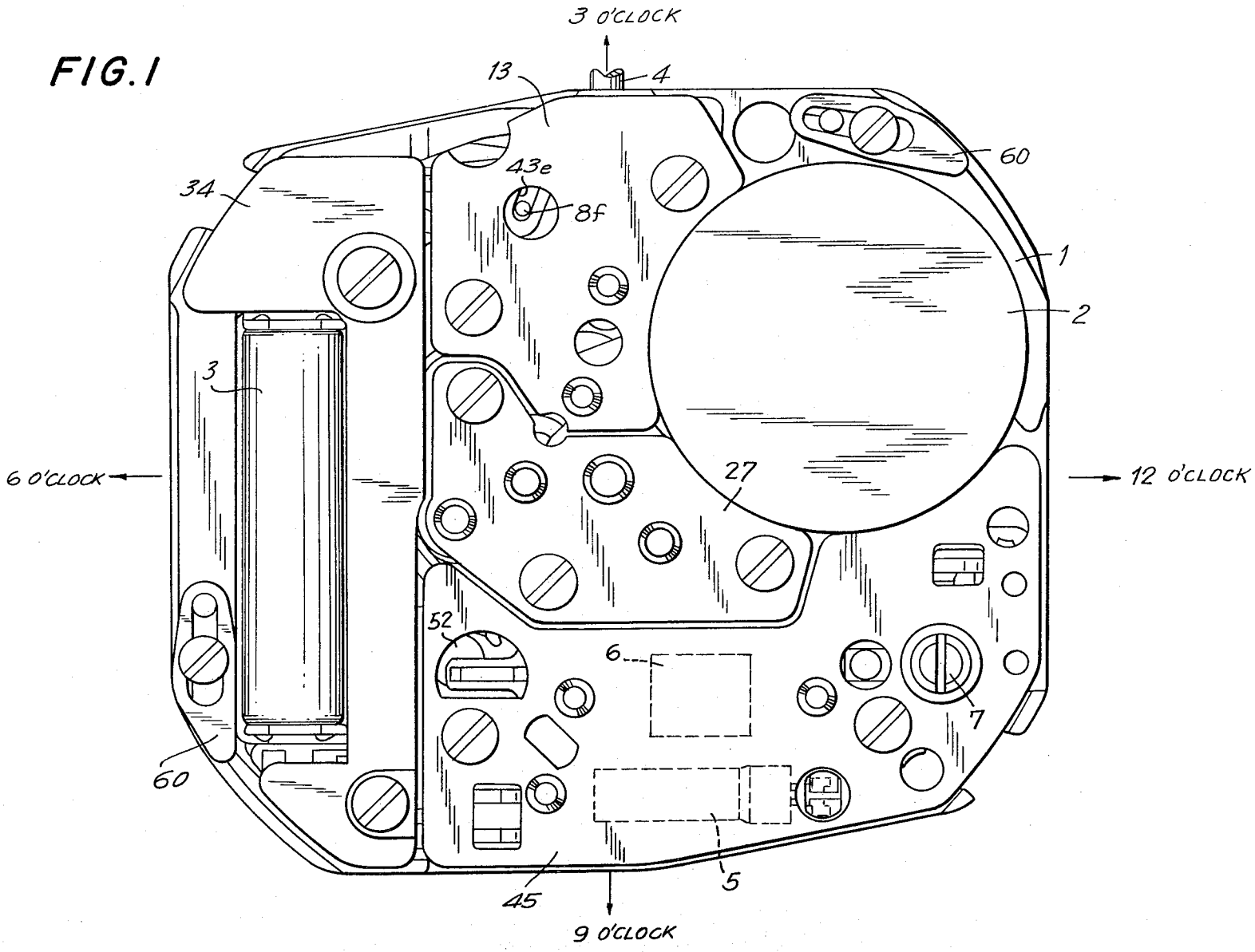
FIG. 1 is a bottom plan view of a quartz crystal wristwatch indicating the position of the major components constructed and arranged in accordance with the invention.

Referring now to FIG. 1 the layout of the principal elements of a quartz crystal wristwatch constructed and arranged in accordance with the invention is shown. The wristwatch includes a main plate 1 formed with four side-cuts for providing a movement having a substantially rectangular layout. In the embodiment illustrated the side-cuts are longer in the 12:00 to 6:00 o'clock direction than in the 3:00 to 9:00 o'clock direction. In addition, in the embodiment illustrated main plate 1 is formed with four corners cut at the side-cuts in four directions so as to provide a substantial curvature about the center of the movement. With the four side-cuts and corners cut in the movement, the movement can be readily positioned within a variety of wristwatch designs, including a round model as well as a square model. For the substantially square model shown, a bayonet type back can be used by making use of the corner cuts formed on the movement so that a square model of remarkably small size can be reliably produced.

As shown in FIG. 1, the wristwatch movement in accordance with the invention is divided into five major regions, namely the battery, the motor, the gear train, the watch circuit and the hand setting assembly. In the embodiment illustrated a battery 2 is disposed substantially in the 1:00 o'clock region; a coil 3 is disposed in the 6:00 o'clock region; a gear train assembly is disposed in the center region under a train wheel bridge 27; a hand setting gear train is disposed in the 3:00 o'clock region under an additional train wheel bridge 13; and a circuit block is disposed on a circuit bridge 45 positioned in the 9:00 o'clock region extending to the 12:00 o'clock region.

The wristwatch movement includes a winding stem 4 at the 3:00 o'clock position substantially parallel to coil 3. Battery 2 is disposed adjacent to winding stem 4 and on the side opposite coil 3. Battery 2 is positioned so that the radial angle between battery center and winding stem 4 is less than a right angle.

The circuit block mounted on circuit bridge 45 includes a quartz crystal oscillator 5 for providing a high frequency time standard signal. Quartz crystal oscillator 5 is disposed in the 9:00 o'clock region substantially perpendicular to the line of winding stem 4 and coil 3. A MOS-IC 6 is disposed between quartz crystal oscillator 5 and the gear train at train wheel bridge 27. MOS-IC 6 is disposed in parallel with quartz crystal oscillator 5 in the 9:00 o'clock region.

The circuit block also includes a trimmer condenser 7 positioned in the 10:00 o'clock region disposed between battery 2 and quartz crystal oscillator 5 and MOS-IC 6. The electrical connection between the circuit block elements and coil 3 is made at the opposite side of MOS-IC 6 than trimmer condenser 7. By positioning the electronic components in this manner, the circuit block has its inputs and outputs positioned on the right hand side and left hand side in FIG. 1, respectively, with respect to the movement center. As a result of this, inspection and correction of circuit block failures can be accomplished smoothly and easily. Thus, a construction in accordance with the invention provides improved after-sale serviceability which enhances the marketability of the timepiece. In addition, by arranging coil 3 and quartz crystal oscillator 5, each having an elongated shape in parallel with the side-cut of main plate 1, the outer sides of the movement can be reduced without adversely affecting the performance of the step motor and the mouting surface of the circuit block.

Figure 2:
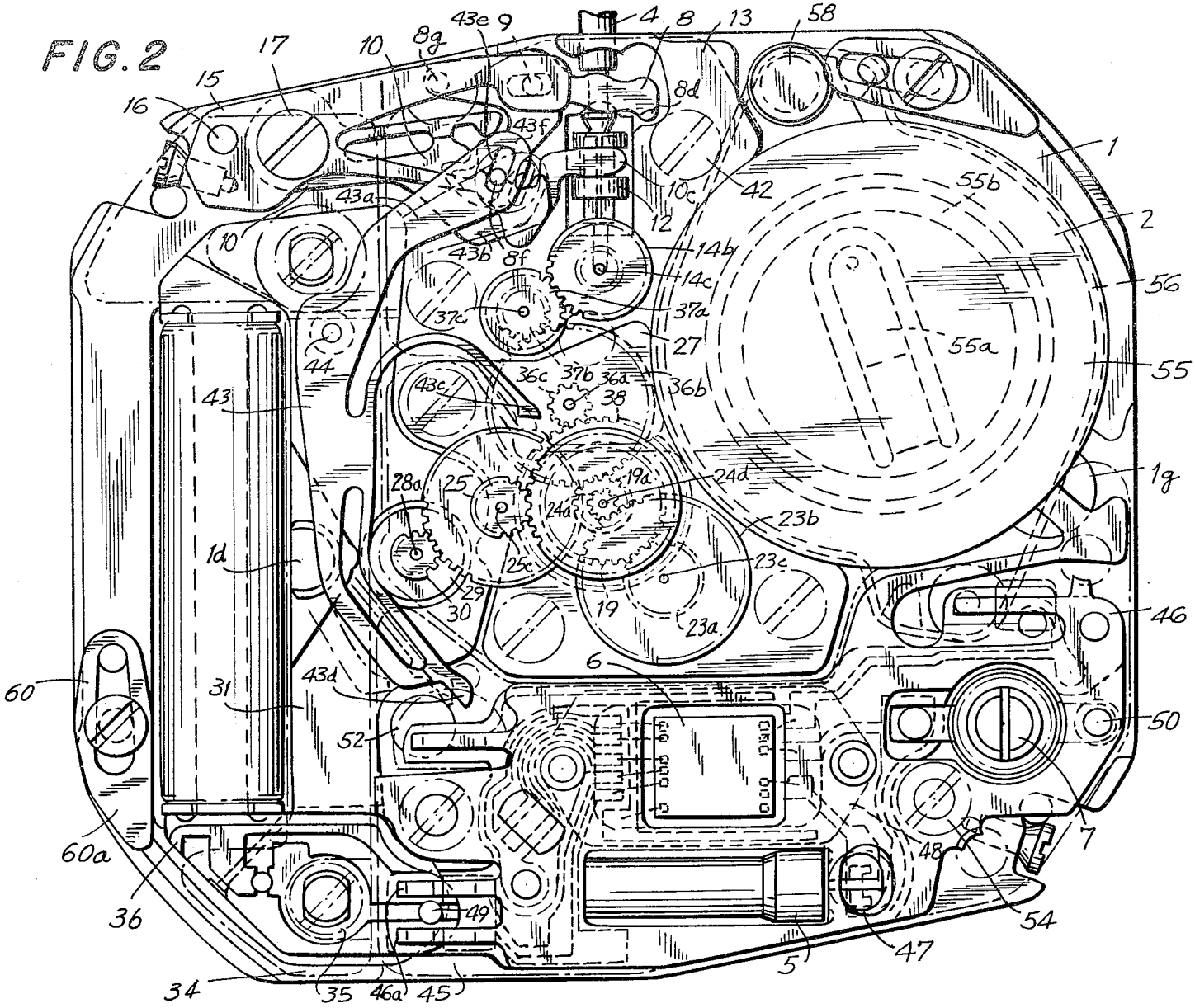
FIG. 2 is a bottom plan view further illustrating the location of gear train and setting assemblies of the wristwatch of FIG. 1.
Figure 3:
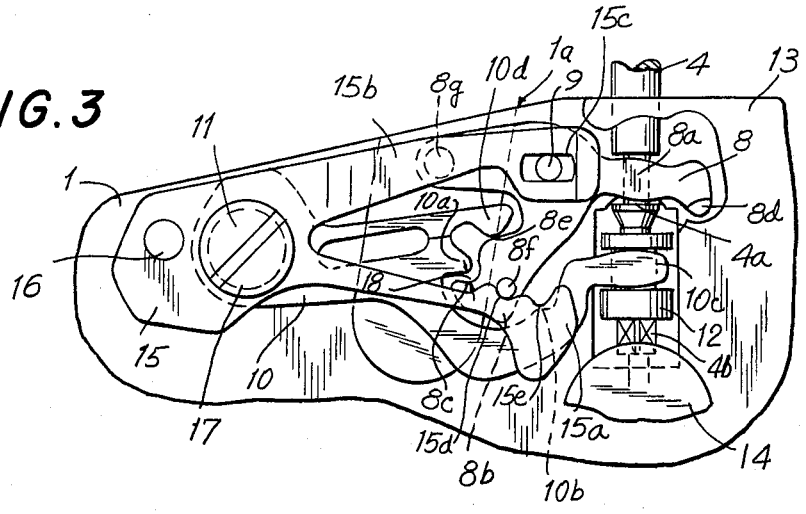
FIG. 3 is a bottom plan view illustrating the setting assembly positioned in the normal time indicating condition for the quartz crystal wristwatch in accordance with the invention.
Figure 4:
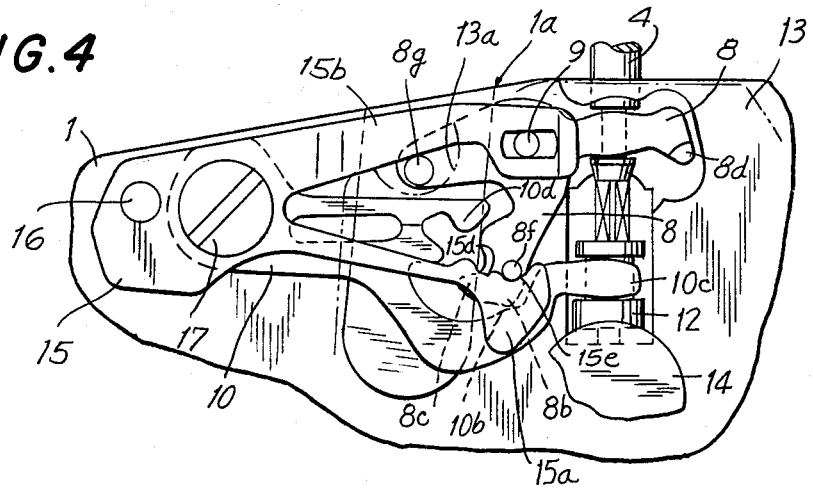
FIG. 4 is a bottom plan view illustrating the setting assembly positioned in the hand setting condition for the quartz crystal wristwatch in accordance with the invention.
Figure 5:
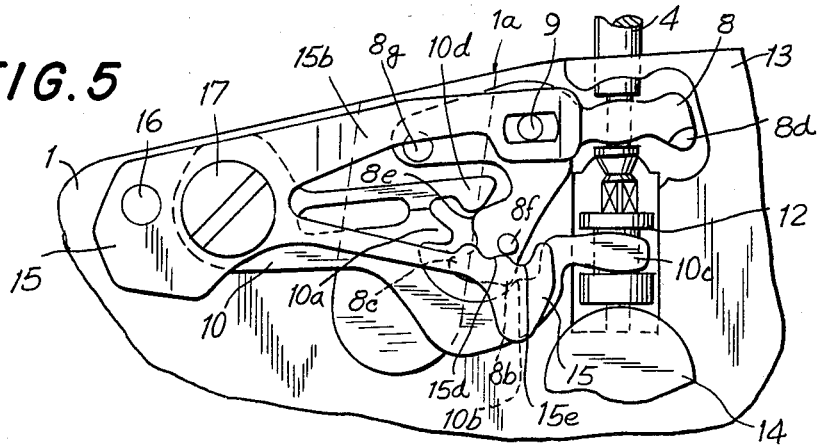
FIG. 5 is a bottom plan view illustrating the setting assembly at the time the hand setting operation commences in the quartz crystal wristwatch in accordance with the invention.

In order to provide a wristwatch of reduced thickness, it is necessary, in part, to arrange the gear train, motor, circuit and hand resetting assembly in a manner so as not to overlap each other. In addition, the circuit elements as noted above do not overlap each other. The following detailed description will now illustrate the movement assembly with initial reference to FIG. 2. FIG. 2 is a plan view from the bottom of the wristwatch assembly illustrating the positioning in accordance with the invention. FIGS. 3 and 4 are also plan views illustrating the hand setting assembly in a first time indicating position and a hand setting position, respectively. FIG. 5 is a plan view illustrating the position of the elements during the change between the time indicating condition and the hand setting condition. FIGS. 6–13, inclusive, are sectional views illustrating the various assemblies of the wristwatch constructed and arranged in accordance with the invention.

Figure 6:
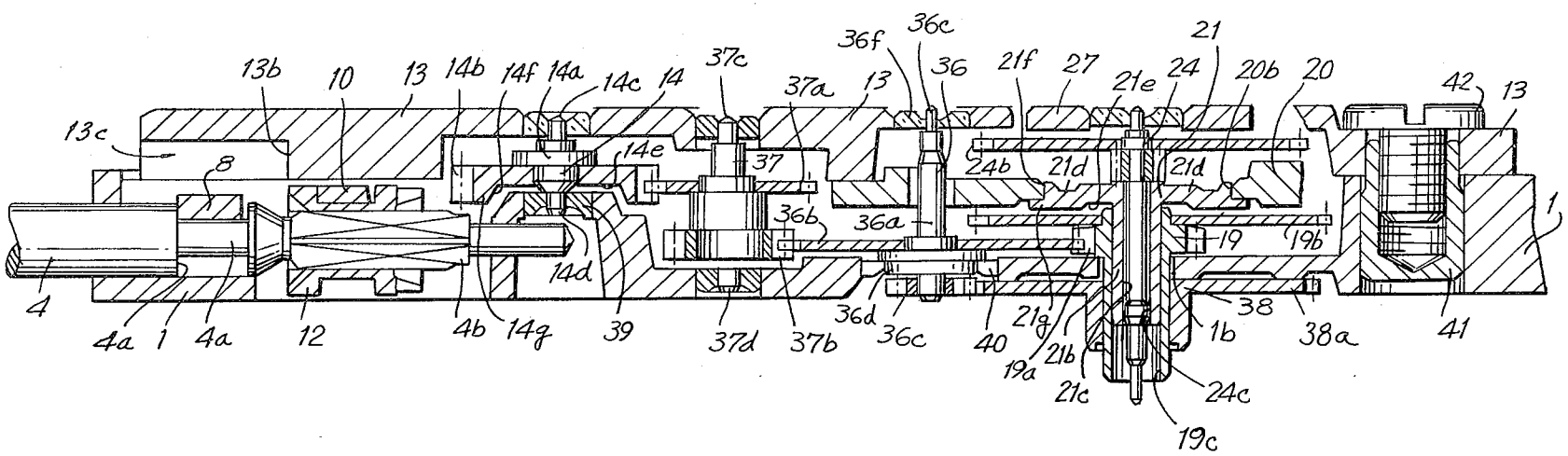
FIG. 6 is a partial sectional view illustrating the hand setting assembly in a quartz crystal wristwatch in accordance with the invention.

Referring now to FIG. 3, a plan view from the bottom of the wristwatch movement illustrating the hand setting assembly in the condition where the hands are advancing normally and time indicating condition is shown. FIG. 4 is similar to FIG. 3, but illustrates the condition of the elements when the hands are being reset. FIG. 6 is a sectional view illustrating the hand setting assembly.

Referring again to FIG. 3, winding stem 4 is shown extending beyond main plate 1. A setting lever 8 is rotatable about a setting lever pin 9 mounted on main plate 1 with a setting portion 8*a* engaged with a groove 4*a* formed in winding stem 4. Setting lever 8 is formed further with a projection portion 8*b* extending towards the central region of the movement, projecting portion 8*b* operatively engaged with a yoke 10 when the elements of the hand setting assembly are in the normal hand advancing position and in the hand adjusting position when winding stem 4 is pulled out from the movement. Setting lever 8 also includes a shoulder portion 8*c* extending in a clockwise direction from projecting portion 8*b*, shoulder portion 8*c* separated from yoke 10 by a gap 18. Shoulder portion 8*c* is operatively engageable with yoke 10 for forcing yoke 10 into the normal hand advancing position from the hand adjusting position when winding stem 4 is pushed into the watch movement. Setting lever 8 also includes a yoke engaging region 8*e* which is adjacent shoulder portion 8*c* for engaging a resilient arm 10*d* of yoke 10 as will be described in more detail below.

Setting lever 8 is also formed with a projecting arm 8*d* which extends from setting portion 8*a* to the opposite side of winding stem 4 for absorbing any impact imparted to winding stem 4 when the wristwatch is dropped. In this case, if winding stem 4 is pushed further towards the center of the movement, setting lever 8 pivots in the clockwise direction forcing projecting arm 8*d* to slip beneath main plate 1. In order to insure projecting arm 8*d* slipping pass the opening in main plate 1, the leading edge of projecting arm 8*d* is tapered.

Yoke 10 is rotatably mounted on a yoke screw pin 11 secured to main plate 1 and positioned to hold projecting portion 8*b* and yoke engaging portion 8*e* of setting lever 8. In order to do this, yoke 10 is formed with an engaging portion 10*a* positioned on the opposite side of gap 18 from shoulder portion 8*c* of setting lever 8 and a setting portion 10*b* for setting a clutch wheel 12 slideably mounted on winding stem 4. Yoke 10 further includes an engaging portion 10*c* extending from setting portion 10*b* for engaging clutch wheel 12. Resilient arm 10*d* absorbs any tolerances of setting lever 8 and yoke 10.

Engaging portion 10*c* of yoke 10 engaged with clutch wheel 12 is curved with a view towards insuring the operational engagement with clutch wheel 12. Engaging portion 10*c* is formed thin at the engaging region to extend over the inner diameter of a groove 12*a* formed about clutch wheel 12. This engagement is insured by a depending region 13*b* formed in additional train wheel bridge 13 as shown in more detail in the cross-section in FIG. 6. Clutch wheel 12 is formed with suitable teeth 12*b* for meshing with a setting wheel 14 mounted between additional train wheel bridge 13 and a setting wheel pivot frame 39 formed over a recess 39*a* formed in main plate 1. Setting wheel 14 is engaged with clutch wheel 12 when the watch hands are being set by rotation of stem 4 in the manner that will be described in more detail below.

Referring again to FIGS. 3–5, a yoke holder 15 formed with a click region 15*a* having a hand advancing click 15*d* and a second hand setting click 15*e* operatively engages a click pin 8*f* mounted on shoulder 8*b* of setting lever 8. Yoke holder 15 includes a resilient arm 15*b* extending along the periphery of main plate 1 for biasing setting lever 8 towards main plate 1. Click portion 15*a* engages click pin 8*f* urging setting lever 8 in the direction of a setting lever pin 9. Yoke holder 15 is formed further with an elongated opening 15*c* which is shaped in this manner for absorbing any variances between yoke holder pin 16 and setting lever pin 9. After yoke holder 15 has been assembled on yoke holder pin 16 on main plate 1, yoke holder 15 is fixed thereto by a yoke holder screw 17 so that wobbling or movement of yoke 15 is eliminated.

The operation of the hand setting assembly shown in FIGS. 3–6 will now be described in detail. Referring specifically to FIG. 3, the normal hand advancing position is shown in a plan view viewed from the bottom surface of the movement. Winding stem 4 is held in this normal hand advancing position by the action of yoke holder 15 and setting lever 8. Clutch wheel 12 is in such a position on winding stem 4 by the action of setting lever 8 and yoke 10 so there is no meshing engagement with setting wheel 14.

A minimum gap is maintained between projecting arm 8*d* of setting lever 8 and main plate 1 to account for variances in parts dimension due to machining tolerances. This protects the wristwatch movement in the case that winding stem 4 in a normal hand advancing position is pushed further into the movement. In other words, when the movement is assembled in a watch case, there is a gap of about 0.2 to 0.3 mm between the edge of the movement and the crown. As a result, the winding stem is pushed until that gap disappears, when it is excessively pushed inwardly or when the watch drops with the crown facing downwardly, setting lever 8 is pivoted in accordance with movement of the winding stem until the gap with the main plate disappears. Additionally, gap 18 is provided between setting lever 8 at shoulder portion 8*c* and yoke 10 at yoke engaging portion 10*a* so that no undue influence is excerted on yoke 10 when the gap disappears. When a high impact is applied to watch stem 4 or when the wristwatch is dropped with the crown facing downwardly, setting lever 8 may be displaced more than the above noted gap between setting lever projecting arm 8*d* and main plate 1. In order to minimize the effect of this movement, the leading edge of projecting arm 8*d* is tapered so that the impact may be absorbed by deformation of main plate 1.

The hand adjusting condition of the hand setting assembly will now be described. When winding stem 4 is pulled out, as shown in FIG. 4, setting lever 8 pivots in a counterclockwise direction about setting lever pin 9 so that setting lever 8 is secured in the hand adjusting position by shifting click portion 15*a* of yoke holder 15. In this connection, click pin 8*f* is displaced from a first position engaged with first click notch 15*d* as shown in FIG. 3 to a second position engaged in second click notch 15*e* as shown in FIG. 4. An intermediate position is illustrated in FIG. 5. When setting lever 8 pivots in the countercockwise direction, yoke 10 pivots in a clockwise direction due to operation of setting lever projection portion 8*b*. Displacement of yoke 10 in the clockwise direction is limited by meshing of setting wheel 14 and teeth of clutch wheel 12. The beginning of this engagement is shown when the assembly is in the intermediate position of FIG. 5. Yoke 10 continues in the clockwise direction due to operative engagement of shoulder portion 8*b* of setting lever 8 so that clutch wheel 12 is slidingly moved along winding stem 4 towards setting wheel 14 by engaging portion 10*c*. At the moment clutch wheel 12 which is operating as a sliding pinion engages setting wheel 14, shoulder portion 8*b* of setting lever 8 and engaging portion 10*b* of yoke 10, and second shoulder portion 8*e* of setting lever 8 and resilient arm 10*d* of yoke 10 are engaged with each other with no gap between each other. By eliminating the play caused at the moment clutch wheel 12 engages setting wheel 14 the start and release of this meshing engagement can be timed with the pulling and pushing operation of winding stem 4. When the movement is returned to the normal hand advancing condition illustrated in FIG. 3, winding stem 4 is pushed towards the center of the movement rotating setting lever 8 in clockwise direction and yoke 10 in a counterclockwise direction to disengage clutch wheel 12 from setting wheel 14.

Referring now to FIGS. 3, 4 and 6, detachment of winding stem 4 from the movement will now be described. In this embodiment of the invention, winding stem 4 may be detached only when in the hand setting condition as illustrated in FIG. 4. In other words, when clutch wheel 12 is engaged with setting wheel 14. In the normal hand advancing condition illustrated in FIG. 3, setting lever 8 has its push pin portion 8*g* hidden from view below yoke holder 15 so that it can not be mauvered in this condition.

In order to remove winding stem 4, winding stem 4 is placed in the hand setting condition illustrated in FIG. 4. Push pin 8*g* of setting lever 8 now appears in view from yoke holder 15. By pushing push pin portion 8*g* of setting lever 8 by means of a pincette, engaging portion 8a which is engaged with winding stem 4 at groove 4a is raised into recess escape portion 13a of a bridge 13 so that winding stem 4 is readily disengagable from setting portion 8a until it can be removed from the internal portion of winding stem 4. When the force on push pin 8a is released, setting lever 8 is again biased towards main plate 1 by the force of resilient arm 15b of yoke holder 15.

Figure 7:
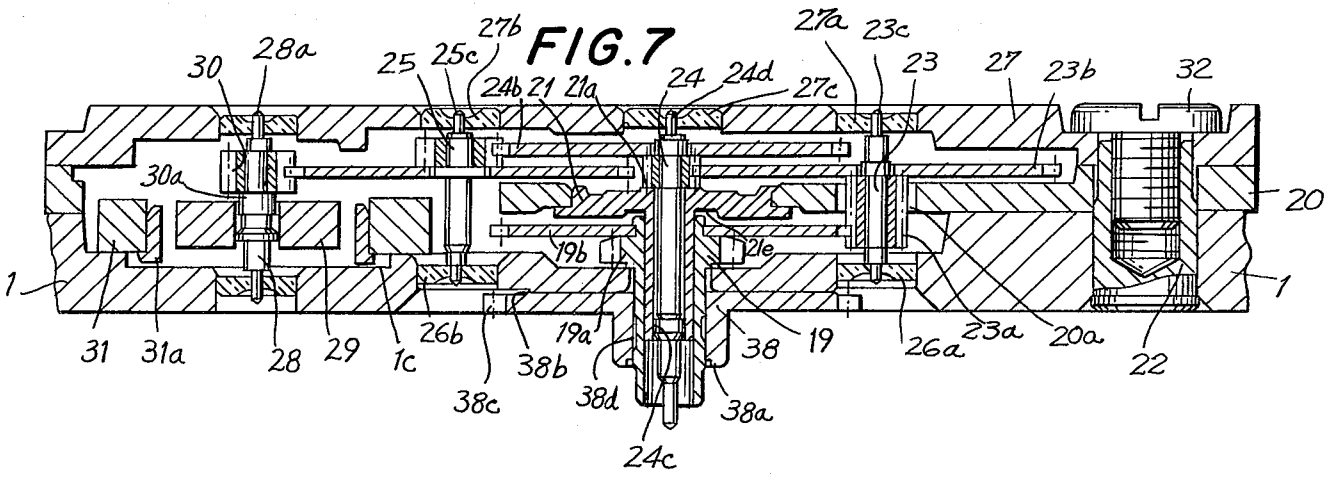
FIG. 7 is partial sectional view illustrating the driving gear train in a quartz crystal wristwatch in accordance with the invention.
Figure 8:
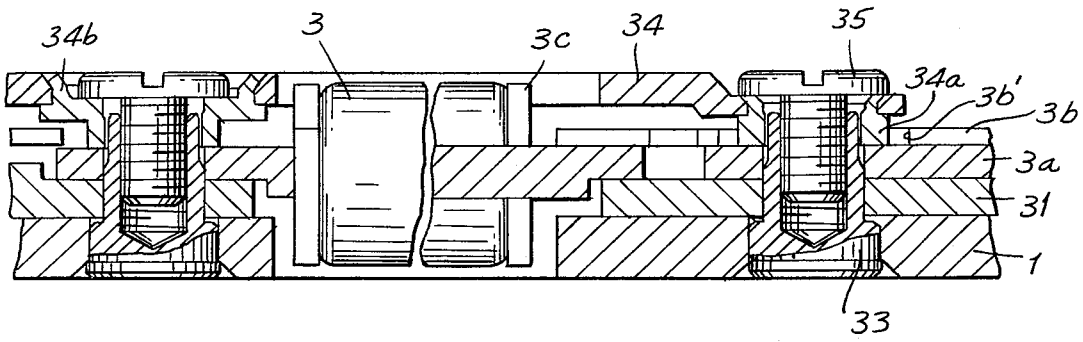
FIG. 8 is a partial sectional view illustrating the step motor assembly of a quartz crystal wristwatch in accordance with the invention.

Referring now to FIGS. 2, 7 and 8 the front gear train and motor assembly in accordance with the present invention will now be described. Turning first to the cross-section in FIG. 7, main plate 1 is shown as the lower pivot for the wheels of the front gear train assembly. An opposed train wheel bridge 27 supports the opposed sides of the wheels and is secured to main plate 1 by feet 22 and screw 32. A center wheel bridge is supported by three feet 22 and screw 32 and is disposed between main plate 1 and train wheel bridge 27. This front gear train assembly is positioned in the central region of the movement as illustrated in FIG. 2.

The pillar-shaped center wheel shaft 21 including a substantially tubular portion 21b having an opening 21c therethrough and a perpendicular disc region 21d is mounted in an opening 20b formed in center wheel bridge 20. Center wheel shaft 21 has central elongated opening 21c for receiving the shaft of a fourth wheel 24 as will be described in more detail below. Tubular portion 21b of center wheel 21 extends from center wheel bridge 20 through an escape hole 1b formed in main plate 1. A center wheel 19 having a center wheel pinion 19a and a center wheel gear 19b is disposed about tubular portion 21b of center wheel shaft 21 and extends above the dial of the watch to a minute hand (not shown). Any wobbling or shaking of center wheel 19 is controlled by the distance between center wheel shaft 21 and main plate 1 at escape opening 1b.

Opening 20a in center wheel bridge 20 accommodates center shaft 21 as noted above, as well as a third wheel 23 and a fifth wheel 25. Center wheel shaft 21 guides a lower pivot 24c of second wheel 24 through central opening 21c as noted above. A bearing surface 21a is formed along the central region of disc portion 21d of center wheel shaft 21 for bearing second wheel 24. The contact area is minimized to prevent formation of an oil ring. Center wheel shaft 21 is also formed with a recess 21e on the side of the disc opposed to bearing surface 21a for elongating the guide surface of center wheel 19 along the outer surface of center wheel shaft 21. In view of the fact that the sectional dimension of the wristwatch movement is limited in the case of a thin wristwatch, the diameter of tubular region 21b of center wheel shaft 21 is inclined at 21f and formed with a flange region 21g extending to a diameter greater than escape opening 20b in center wheel bridge 20. Center wheel shaft 21 is fixed to center wheel bridge 20 at flange 21g by a caulking method.

Third wheel 23 and fifth wheel 25 are positioned between train wheel bridge 27 and main plate 1 by a pivot jewels 26a and 26b, respectively, which are mounted in main plate 1 and by pivot jewels 27a and 27b which are mounted in train wheel bridge 27. The distance between pinion 23a of third wheel 23 and an escape opening 20a in center wheel bridge 20 is minimized so that third wheel 23 cannot be inclined during assembly.

Fourth wheel 24 has a lower pivot 24c guided by central hole 21c of center wheel shaft 21 and an upper pivot 24d guided by a pivot jewel 27c mounted in train wheel bridge 27. Shaking of fourth wheel 24 is limited by center wheel shaft 21 and pivot jewel 27c.

Referring again to FIG. 7, the step motor includes a rotor 28 which is rotated by the magnetic flux generated in coil 3 by the pulsating current generated by the circuit block elements functioning as the timekeeping circuit. Rotor 28 includes a rotor magnet 29 and a rotor pinion 30. Rotor pinion 30 is formed with axially extending circumferential grooves at an engaging surface 30a for engaging rotor magnet 28 so that a substantial rotating torque will be developed between rotor pinion 30 and rotor magnet 29 and that rotor pinion 30 will be retained on rotor 28. Alternatively, the grooves on engaging surface 38 may be replaced by side-cuts or the like.

As noted above, train wheel bridge 27 rotatably supports upper pivot 23c of third wheel 23, upper pivot 24d of fourth wheel 24, upper pivot 25c of fifth wheel 25 and upper pivot 28a of rotor 28. Train wheel bridge 27 is mounted to main plate 1 by train wheel bridge feet 22 and secured with center wheel bridge therebetween by train wheel bridge screw 32. The motor also includes a stator 31 for guiding the magnetic flux generated by coil 3 to rotor 28. A stator brush 31a is retained within stator 31 with a minor fitting allowance between the back of stator brush 31a and stator 31. This minor fitting allowance insures that no strain exists on stator brush 31a so as to effect magnetizing action of stator 31 adversely. In order to insure this main plate 1 at the location of stator brush 31a is provided with a recessed escape region 1c. Even in cases where interference between stator 31 and stator brush 31a is very small the extracting force cannot be attained, the gap between main plate 1 and stator 31a is minimized so that stator brush 31a may not come out when stator 31 is assembled on main plate 1. Moreover, the contacting region between stator 31 and coil core 3a are enlarged to minimize the overall thickness of the movement. Stator 31 has the thickness of its front side reduced by one-third whereas coil core 3a has its back side reduced by a thickness of one-third. Stator 31 is retained between main plate 1 and coil core 3a by a shield plate screw pin 33.

Referring specifically to FIG. 8, coil 3 includes core 3a, coil lead plate 3b and a coil frame 3c. Coil lead plate 3b is formed from patterns of copper foil on a base which is generally formed from a polyimide tape or a glass fiber reinforced epoxy plate and is fixed to core 3a. A shield plate 34 which includes a first shield plate bushing A 34a and a second shield plate bushing B 34b mounted thereto is guided by shield plate screw pin 33 and bushings A and B (34a and 34b) and is fixed to main plate 1 by a fixing screw 35. Coil lead plate 3b is formed with an escape hole 3b' so that bushing cap A 34a directly holds core 3a therethrough.

Referring to FIGS. 2 and 6, the hand setting gear train assembly for operatively transmitting rotation of the winding stem to the time indicating gear train assembly previously described when the hand adjusting operation is performed when winding stem 4 is displaced outwardly from the movement will now be described. As is well known in the art, the setting gear train assembly is constructed to include a minute wheel 36, and intermediate wheel 37, setting wheel 14 and an hour wheel 38. In conventional constructions, minute wheel 36 and setting wheel 14 are freely mounted on pins planted on main plate 1. In contrast, in a construction in accordance with the present invention, all the wheels of the gear train are rotatably supported at both the upper and lower pivots.

As shown in FIGS. 2 and 6, setting wheel 14 meshes with clutch wheel 12 when winding stem 4 is displaced to the hand adjusting position as shown in FIG. 4. At this time, rotation of winding stem 4 is transmitted to the time indicating gear train assembly of FIG. 6. Setting wheel 14 includes a setting wheel shaft 14*a* and a setting wheel gear 14*b* with upper pivot 14*c* and lower pivot 14*d* being highly polished. Setting wheel gear 14*b* is formed with a recess 14*e* on the side facing main plate 1 and has a side-cut 14*f* opposite its tooth region 14*g*. Main plate 1 is formed with a cooperating setting wheel pivot frame 39 for entering recess 14*e* and supporting lower pivot 14*d*.

The meshing engagement between clutch wheel 12 and setting wheel 14 has shown in the cross-section in FIG. 6 occurs in the region of setting wheel pivot frame 39. A gap between setting wheel pivot frame 39 and winding stem 4 is formed taking oil drainage into consideration. In order to retain the gap between setting wheel 14 and a camphored portion 4*b* of winding stem 4, the leading end of camphored portion 4*b* of stem 4 is tapered. Upper pivot 14*c* of setting wheel 14 is pivotably borne in additional train wheel bridge 13.

Setting wheel 14 and gear 14*b* have been described as separate members in accordance with this embodiment. However, it is clearly within the contemplation of the invention that they may be integrated and formed from a single member. In this case, hand adjusting actions would be transmitted from clutch wheel 12 to setting wheel 14 and in turn to intermediate minute wheel 37.

Intermediate minute wheel 37 includes an intermediate minute gear 37*a* and an intermediate minute pinion 37*b* in the usual fashion. An upper intermediate minute wheel pivot 37*c* is pivotally borne in additional train wheel bridge 13 and a lower intermediate minute wheel pivot 37*d* is pivotably borne in main plate 1. Intermediate minute wheel gear 37*a* and intermediate minute wheel pinion 37*b* are in operative engagement with setting wheel 14 and minute wheel 36 (which will be described in detail below), respectively. Any gap between intermediate minute wheel 37 and center wheel bridge 20 is minimized to prevent any inclination of intermediate minute wheel 37 while attempting to improve the pivoting bearing performance in accordance with this embodiment of the invention.

Referring again to FIG. 6, minute wheel 36 includes a minute shaft 36*a*, a minute wheel gear 36*b* and minute wheel pinion 36*c*. Minute wheel gear 36*b* and minute wheel pinion 36*c* are secured with suitable rotating torque and engagement force to minute wheel shaft 36*a*. Minute wheel 36 has a lower pivot 36*d* mounted in a lower pivot frame 40 which is fixed to main plate 1. The diameter of lower pivot 36*d* of minute wheel 36 is slightly larger than the diameter of minute pinion 36*c* on the opposed side thereof in order to improve ease of assembly and oil holding characteristics. An upper pivot 36*e* of minute wheel 36 is pivotably borne in an upper pivot jewel 36*f* which is mounted in additional train wheel bridge 13.

In the construction of a quartz crystal wristwatch in accordance with the invention described above, shaking of minute wheel 36 is limited by both lower pivot frame 40 which is fixed to main plate 1 and upper pivot jewel 36*f* which is mounted in additional train wheel bridge 13. On the lower pivot side of minute 36, minute wheel 36 is guided in the radial direction by lower pivot frame 40 and the end face of lower pivot 36*d* of minute wheel shaft 36*a* which also acts as a stopper in the thrusting direction by use of a fixing member (not shown).

If minute wheel 36 shakes at its upper pivot side in accordance with the construction illustrated in FIG. 6, any frictional loss between upper pivot 36*e* and the pivot frame can be reduced. Additional train wheel bridge 13 for pivotably bearing setting wheel 14, intermediate minute wheel 37 and minute wheel 36 is simply guided by an additional train wheel bridge foot 41 mounted on main plate 1 so that it does not overlap train wheel bridge 27. Additional train wheel bridge 13 is fixed by means of an additional train wheel bridge screw 42. Further, additional train wheel bridge 13 is formed with a recess region 13*a* for facilitating the removal of winding stem 4 as described above. Additional train wheel bridge 13 is also formed with an opening 13*b* in the region of winding stem 4 for confirming the engagement of yoke holder 15 with click pin 8*f* of setting lever 8 and a second hand-setting lever 43 which will be described in detail below. Moreover, this opening permits inspection of any shaking of intermediate minute wheel 37, setting wheel 14 and the like.

Time displaying gear train has been described above during the hand adjusting operation. In this case powers transmitted to center wheel 19 from minute wheel 36 which in turn is rotated by intermediate minute wheel 37 from setting wheel 14. An hour wheel 38 is freely mounted about center wheel 19 in the conventional manner well known in the art. Hour wheel 38 is formed with a step region 38*b* in the region of gear teeth 38*c* in order to prevent any interference with main plate 1. In addition, hour wheel 38 is formed at its hand supporting side with a tubular region 38*d* having a recess 38*a* for maintaining a gap from minute hand pipe 19*c* of center wheel 19.

Figure 9:
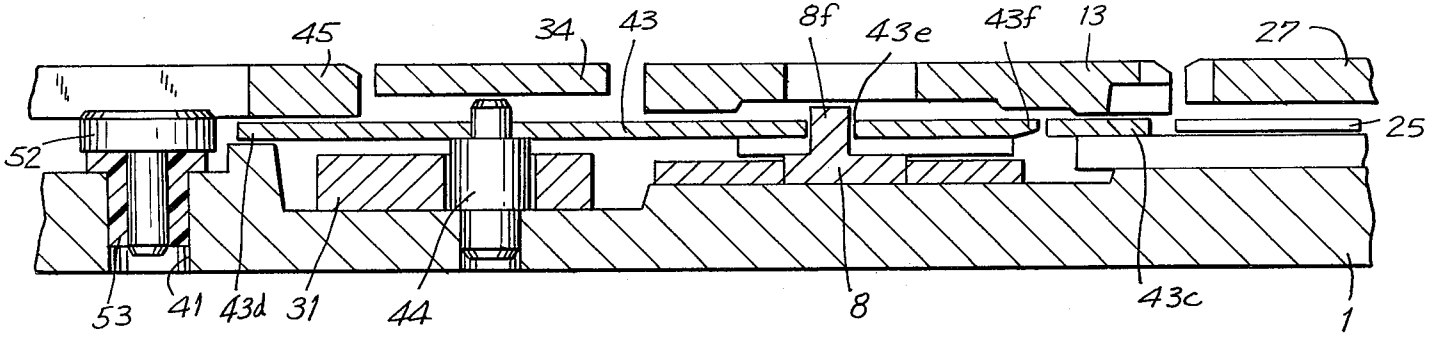
FIG. 9 is a partial sectional view illustrating the hand setting lever assembly in a quartz crystal wristwatch in accordance with the invention.

Referring now to FIG. 2 and 9, a second-setting lever 43 is positioned at a position 43*a* under normal hand advancing conditions and at a position 43*b* during hand adjusting conditions. Second-setting lever 43 turns about a shaft 44 mounted in main plate 1. Second hand setting lever 43 includes a first resilient arm 43*c* which is operatively engaged to the front train gear assembly during hand adjusting, a second resilient arm 43*d* which is operatively engaged for resetting the circuit unit during hand adjusting, and a substantially rigid arm 43*f* having a track hole 43*e* engaged with click pin 8*f* on setting lever 8.

The shaking of second-setting lever 43 is accurately set at its operating portions, namely rigid arm 43*f* engaged with click pin 8*f* on setting lever 8, the central portion of rotation about pivot 44, setting spring resilient arm 43*c* and the reset spring arm 43*d*. The remaining regions of second-setting lever 43 remain free. The shaking of rigid arm 43*f* engaged with click pin 8*f* of setting lever 8 is limited on the back surface thereof by yoke holder 15 and at the front side by additional train wheel bridge 13.

Shaking on the front side is determined by taking the inclination of second-setting lever 43 into consideration when setting lever 8 is inclined during detachment of winding stem 4. The shaking at the central portion is determined on the back side by train wheel setting lever shaft 44 and on the front side by shield plate bushing B 34*b*. Shaking of resilient arm 43*c* is determined on the back surface by center wheel bridge 20 and on its front surface by additional train wheel bridge 13. Shaking of second resilient arm 43*d* is determined on its back side by main plate 1 and at its front side by circuit bridge 45 which will be described in more detail below. Substantially rigid arm 43*f* located at the center of rotation and resilient portion 43*c* ride on a remaining portion 1*d* of main plate 1 along the back side.

Setting and resetting of the hands in a thin movement of the type described can be formed accurately by restricting the shaking the major elements as noted. By maintaining the other regions free, the setting and resetting operations can be reliably performed, even with the warp and deformation which results from the machining processes. The back side of rigid portion 43*f* formed with track-shaped opening 43*e* is camphored to provide an escape for any inclination of setting lever 8 during the winding stem removing operation. Additionally, this prevents any interference with click portion 15*a* of yoke holder 15 during the hand setting operation of second hand setting lever 43.

Referring now to FIG. 9, the second-setting operation will now be described in detail. When winding stem 4 is in the first position of normal hand advancing condition as shown in FIG. 3, the gaps are maintained when second-setting lever 43 takes position 43*a* between the leading end of resilient arm 43*c* and fifth wheel 25 and between the leading end of second resilient arm 43*d* and a reset pin 52 which will be described in more detail below. Second-setting lever 43 is spaced from train wheel bridge 27 which supports the wheels in the displaying gear train assembly. When winding stem 4 is pulled outwardly, setting lever 8 is turned in a counterclockwise direction as indicated in FIG. 4 and noted above so that second-setting lever 43 is similarly turned in a counterclockwise direction about shaft 44. As winding stem 4 is pulled out, second resilient arm 43*d* is brought into contact with respect pin 52 disposed in the 10:00 o'clock region of circuit bridge 45. At this time, first resilient arm 43*c* sets fifth wheel 25. After this second hand setting operation, clutch wheel 12 is brought into meshing engagement with setting wheel 14.

The shape of first resilient arm 43*c* of second setting lever 43 is characterized in that the base of the resilient member is positioned at the side of rotation with respect a straight line joining the center of rotation and the contacting region with fifth wheel 25. In this embodiment it is advantageous that the spring force can be overcome without any difficulty because the contacting pressure is provided by spring forces independent of the setting and resetting spring members. On the other hand, the rotating stroke of the train wheel setting lever can be easily changed by changing the inclination of track-shape opening 43*e* formed in rigid arm 43*f* and engaged with click pin 8*f* of setting lever 8. Second setting lever 43 may be fabricated at a significantly lower price because it does not have any bent regions.

Referring now to FIGS. 2, 10, 11 and 12 the circuit block including battery 2, quartz crystal oscillator 5, MOS-IC 6, trimmer condenser 7 and associated elements will now be described. The electronic wristwatch circuit according to this embodiment of the invention has an integral structure including three parts. The first is circuit bridge 45, circuit lead plate 46 and a circuit board 47 as shown in the cross-sections in FIGS. 10 and 11. Circuit lead plate 46 and circuit board 47 are mounted to circuit bridge 45 by means of a molded frame 48. Circuit board 47 is formed with patterns of copper foil 47*a* on the back surface (side facing the watch face) by using a polyimide tape as a base. Circuit lead plate 46 provides a biasing force necessary to insure the electrical connections of the input and output of the wristwatch circuit. Circuit board 47 merely provides the patterns of the circuit and will suffice if flexible and deformed by the biasing force of the spring portions of circuit lead plate 46.

The following benefits are obtained by making the parts for establishing contact pressure at the electrical contacts separately from the parts for completeing the connections. As the electrode patterns are made of vary thin copper foil, the width and spacing of the patterns can be minimized to enjoy the advantage that the board carries a highly dense pattern and that the electrical connection can be easily and reliably performed through spring contact by use of a metal member having resilient properties. In accordance with the present invention, shortcircuiting with other parts due to displacement of the spring regions is avoided. This may occur in the construction wherein the electrode patters are formed directly on a resilient metal plate. This is obtainable because the electrode patterns are on a separate plate from the spring members. Circuit bridge 45 is provided for increasing the strength of the circuit block.

Circuit bridge 45, circuit lead plate 46 and circuit board 47 are arranged in this order sectionally. Circuit board 47 is formed with escape holes for quartz crystal oscillator 5, MOS-IC 6 and the like. Circuit lead plate 46 is shaped for providing spring regions at the positive and negative battery terminal regions, the output terminal regions and the reset terminal region. Quartz crystal oscillator 5 is soldered or welded to circuit board 47 and then mounted to circuit bridge 45 by means by an adhesive. The horizontal positioning of quartz crystal oscillator 5 is performed by circuit lead plate 46 and circuit board 47. On the other hand, MOS-IC 6 is mounted to circuit bridge 45 by means of an adhesive 6*a* and then wire-bonded to the electrical pattern on circuit board 47. After this wire-bonding procedure, MOS-IC 6 is wrapped by means of a potting treatment. In order to prevent the potting agent from flowing out of the circuit block, molded frame 48 for circuit board 47 is formed with a pattern for that purpose. A trimmer condenser fixing spring 7*a* from the positive side is connected to circuit bridge 45 by a trimmer condenser fixing pin A 50. The gate terminal of trimmer condenser 7 is caulked by means of a second fixing pin B 51 for providing direct contact with circuit board 47. The load to be applied during the setting operation is borne upon main plate 1 by reducing the sectional gap between trimmer condensers 7 and main plate 1.

As a result of this manner of assembly, there is no fear that the bonding strength between trimmer condenser 7 and circuit board 47 is insufficient. Additionally, shifting does not occur during adjustment of trimmer condenser 7 making it possible to obtain stable regulation. Main plate 1 at the center of trimmer condenser 7 is formed with an access opening 1*e* for receiving a jig for automatic adjustment operations. These can be easily performed during servicing operations.

Figure 10:
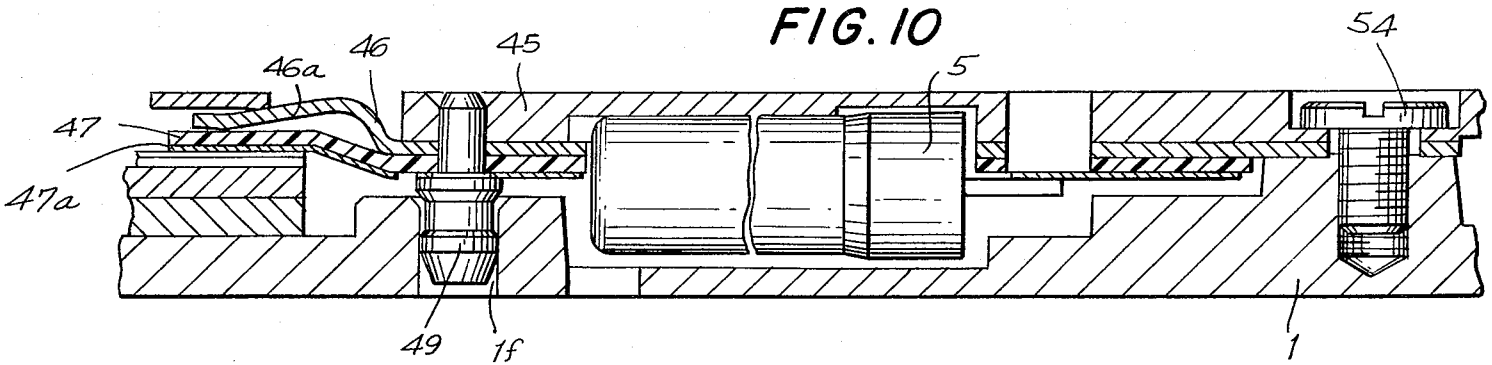
FIG. 10 is a partial sectional view illustrating the quartz crystal oscillator region of the circuit assembly in a quartz crystal wristwatch in accordance with the invention.
Figure 11:
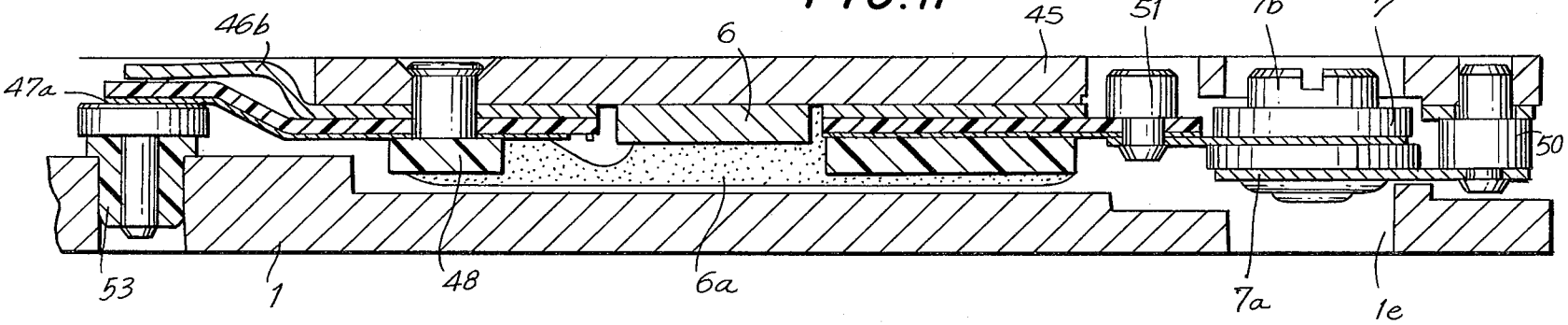
FIG. 11 is a partial sectional view illustrating the trimmer condenser region of the circuit assembly in a quartz crystal wristwatch in accordance with the invention.

The connecting structure of the output terminal, reset pin 52 and positive and negative terminal regions will now be described. Referring now to FIG. 10, the output terminal region is shown. Circuit lead plate 46 includes a output terminal spring 46*a* arranged so that the output patterns of circuit board 47 contact with coil lead terminal 3*b* which is fixed to coil core 3*a* as shown in FIG. 8. Moreover, output terminal spring 46*a* of circuit lead plate 46 is retained in biasing engagement against circuit board 47 by circuit bridge 45. The reset portion has a reset pin and a reset insulating frame 53 inserted into a tightly fitting allowance 1*h* formed in main plate 1. The contacting method at reset method 52 is similar to that of output region such that holding of circuit board 47 with electrode terminals 47*a* against reset pin 52 is maintained by a reset spring portion 46*b* formed on circuit lead plate 46, but not by circuit bridge 45.

Figure 12:
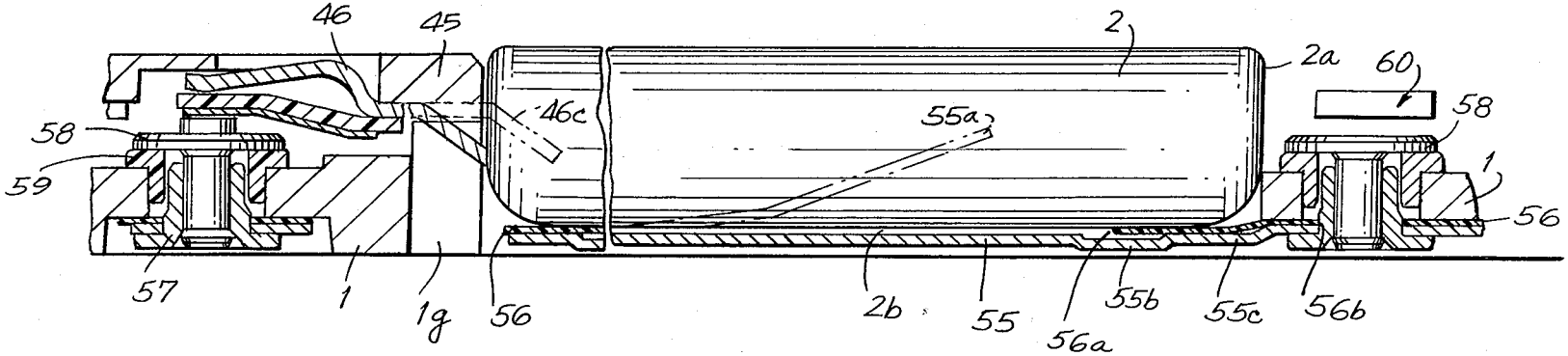
FIG. 12 is a partial sectional view illustrating the battery and associated contacts in the circuit in a quartz crystal wristwatch in accordance with the invention.

Circuit lead plate 46 includes a positive terminal 46*c* bent downwardly toward main plate 1 as shown in FIG. 12. The leading edge of positive terminal 46*c* contacts with the side 2*a* or anode of battery 2. When battery 2 is accommodated within the watch movement, positive terminal 46*c* of circuit lead plate 46 is displaced to a notched opening 1*g* in main plate 1. Positive conduction is effected through circuit lead plate 46 and further through a circuit block pin 49 (FIG. 10) and circuit board 47 to MOS-IC 6. The negative terminal portion is made in the same manner as reset region wherein circuit lead plate 46 is formed with a spring region. The circuit block as constructed in this manner is positioned within the wristwatch movement by both a guide hole 1*f* formed in main plate 1 and by block pin 49 fixed therein and circuit lead plate 46 is secured to main plate 1 by means of a circuit bridge screw 54.

Battery 2 is supported at its outer circumference by main plate 1, additional train wheel bridge 13, train wheel bridge 27 and circuit bridge 45. A battery lead plate 55 formed with a tongue 55*a* is fixed to a battery escape opening 1*h* in main plate 1. Battery lead plate 55 is bonded to main plate 1 through a battery insulator 56 disposed between battery lead plate 55 and main plate 1 by means of an insulating frame 59, a battery lead pin 58 and a battery lead frame 57. The battery connection with main plate 1 is prevented from being short circuited by insulating frame 59 and battery insulator 56. Battery insulator 56 is formed at its central region with an escape opening 56*a* for the cathode region 2*b* of battery 2 and a further escape opening 56*b* for battery lead pin 58 and has a symetrical shape about its central region. As a result of this construction, battery insulator 56 can be assembled by merely discriminating between its front and back surfaces. Moreover, insulation is provided not only between battery lead plate 55 and main plate 1, but also between battery lead plate 55 and anode 2*a* of battery 2.

As wristwatch movements are made thinner, the battery connection becomes thinner so that they do not possess sufficient strength for bearing the load of the battery by themselves. In accordance with the embodiment described, the bearing strength of battery lead plate 55 can be substantially improved by providing a drawn region 55*b* and 55*c*. As noted above, since the battery is supported over its entire circumference, there is no problem that the battery may pop up due to shock of dropping the wristwatch or that the battery will have a deformed positive terminal. By constructing the battery unit in accordance with this embodiment of the invention, it is possible to make the battery unit only about 0.2 mm thicker than battery 2 itself. Insulation of the battery connection at its back surface can be easily performed by covering it with an insulating film (not shown) of polyester or the like.

Figure 13:
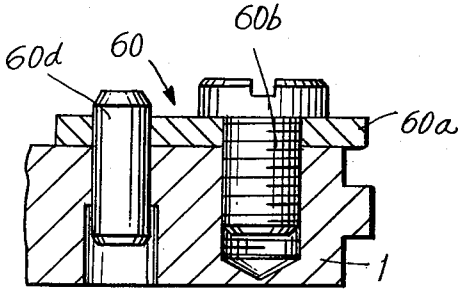
FIG. 13 is a partial sectional view illustrating the casing clamp assembly in a quartz crystal wristwatch in accordance with the invention.

Referring to FIGS. 2 and 13, means for clamping the movement to a watch casing is shown. A casing clamp 60 including a contacting region 60*a* is secured by a clamp screw 60*b* to main plate 1. Contacting portion 60*a* is formed with an elongated opening 60*c* for engaging a clamp pin 60*d*. Contacting portion 60*a* is of sufficient size so that the wristwatch movement can be retained within the watch case securely. In the embodiment illustrated, the movement can easily be removed from the watch casement by s liding the casing clamp 60 along clamp pin 60*d*.

It is apparent from the showings in FIGS. 6–12 that in a wristwatch movement constructed and arranged in accordance with the invention, all the screws, batteries, antimagnetic parts and accessories are accommodated in the movement at the same height without protruding from the upper side of train wheel bridge 27. Additionally, as noted above, in the construction in accordance with the invention, a gear train, motor, circuit and setting assembly are arranged so as not to overlap one another in order to reduce the thickness of the wristwatch movement. By constructing and arranging the watch movement in this manner, it is possible to provide a small and thin electronic analog wristwatch. Additionally, since the movement parts are all in the same plane and finished with metal surfaces, it is possible to provide a clear and aesthetically pleasing appearance to the wristwatch movement. Furthermore, in a movement which has its thickness reduced in mass production by making all the gear trains with both pivot supported as in the present invention, with a view towards realizing along life from a thin battery, it is necessary to eliminate the phenomenon that the sectional gap between elements is to strict due to burrs formed on gears and bridges as much as possible. Under these conditions, it is difficult to bear the gears pivotably in a stable manner in the construction wherein the pivots of the setting gear train and driving gear train are supported by means of a single bridge plate. Additionally, it is almost impossible to avoid pivoting the wheels in a thin wristwatch with the use of a pinsette, or the like. As has been described above, by pivotably bearing the gear trains in accordance with the instant invention with the use of two bridges, the assembly characteristics can be remarkably improved. Specifically, the use of a train wheel bridge and an additional train wheel bridge provide that the setting gear train is pivotably borne by the former bridge, whereas the driving gear train is borne by the latter bridge. Accordingly, upon constructing and arranging an electronic analog display quartz crystal wristwatch in accordance with the present invention, it is possible to obtain a thin and small wristwatch which enjoys high accuracy and is easily serviced after sale.

It will thus be seen that the objects set forth above, and those made apparent from the preceding description, are efficiently attained and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An analog display quartz crystal wristwatch comprising:

a quartz crystal time standard oscillator means for providing a high frequency time standard signal;

circuit means including a driving circuit for providing a low frequency time standard signal in response to said time standard signal oscillator means;

driving motor means including a driving coil and a stepping motor driven in response to said low frequency time standard signal applied by said driving circuit;

battery power means coupled to said oscillator means, circuit means and driving coil for energizing these elements;

a main movement support plate;

time display gear train means operatively coupled to said stepping motor for displaying time in analog fashion;

a winding stem selectively operably engagable with said time display gear train means for adjusting said time display gear train means;

a center wheel bridge spaced apart from and mounted on said support plate; and a pillar-shaped center wheel shaft having a tubular region and a perpendicular disc-shaped region with a central opening, said pillar-shaped center wheel shaft mounted to said center wheel bridge for supporting a cannon pinion about the tubular region, said cannon pinion penetrating the support plate;

said time display gear train means including a center wheel having a center wheel gear and a center wheel pinion disposed between said support plate and said center wheel bridge;

an hour wheel disposed on the opposite side of said support plate as said center wheel;

said support plate having a minute wheel opening;

a minute wheel in said minute wheel opening and having a minute wheel gear engaged with said center wheel pinion, a minute wheel pinion engaged with said hour wheel and a connecting member therebetween, said minute wheel pinion being smaller than said minute wheel opening and said minute wheel gear being larger than said minute wheel opening, said connection member secured in said minute wheel opening.

2. The quartz crystal wristwatch of claim 1, wherein said pillar-shaped center wheel shaft includes a bearing surface for supporting a rotating wheel of said time display gear train means.

3. The analog display quartz crystal wristwatch of claim 1, further comprising:

said winding stem arranged along a line drawn through the mid-point of said support plate for operating and setting the wristwatch;

a setting assembly coupled to said winding stem for selectively placing said winding stem into a setting mode for setting the wristwatch; and a setting gear train coupled to said time display gear train and selectively couplable to said setting assembly for setting said time displaying gear train by selectively operating said winding stem;

a line from the center of said battery power means to the center of the support plate and the line through the winding stem and center of the support plate at an angle of less than 90°;

said battery power means, oscillator means and circuit means arranged on one side of said winding stem and said coil and setting assembly arranged on the opposite side of said winding stem;

said battery power means, circuit means, oscillator means, driving motor means, time displaying gear train, setting gear train and setting assembly arranged in a plane on said support plate so as not to overlap each other in plan view.

4. The quartz crystal wristwatch of claim 1, wherein circuit means is a MOS-IC.

5. The quartz crystal wristwatch of claim 1, wherein said circuit means includes input terminal means for electrical connection of said battery power means and output terminal means for electrical connection to said converter and setting assembly, said input terminal means arranged on said support plate on the same side of the winding stem as the battery power means and said output terminal means arranged on said main plate on the same side of said winding stem as said coil.

6. The quartz crystal wristwatch of claim 3, wherein said coil is arranged on said support plate substantially parallel to said winding stem.

7. The quartz crystal wristwatch of claim 1, wherein said support plate is substantially rectangular having four sides and four corners, the coil arranged on said main plate substantially parallel to one side.

8. The quartz crystal wristwatch of claim 5, wherein said side parallel to said coil is a shorter side of said main plate.

9. The quartz crystal wristwatch of claim 5, wherein each of said four corners is cut for imparting a substantial curvature about the center point of the wristwatch movement.

10. The quartz crystal wristwatch of claim 1, wherein said time displaying gear train is mounted on said main plate at the central region thereof, said battery power means is arranged adjacent to said winding stem, said circuit means is arranged adjacent to said battery power means, said coil is arranged adjacent to said circuit means and said setting assembly is arranged between said coil and said winding stem about the periphery of said support plate.

11. The quartz crystal wristwatch of claim 1, further including a time displaying gear train bridge for pivotably supporting the time displaying gear train and an additional train wheel bridge for pivotably supporting the setting gear train.

12. The quartz crystal wristwatch of claim 9, wherein the wheels of the time displaying gear train and the wheels of the setting gear train are rotatably supported at upper and lower pivots.

13. The quartz crystal wristwatch of claim 10, wherein said time displaying gear train includes a rotor pinion of said stepping motor, a fifth wheel, a fourth wheel, a third wheel, a center wheel, a minute wheel, and an hour wheel each wheel including a gear and a pinion, said rotor pinion driving said fifth wheel gear, said fifth wheel pinion driving said fourth wheel gear, said fourth pinion driving said third wheel gear, said third pinion driving said center wheel gear, said center wheel pinion driving said minute wheel gear and said minute wheel pinion driving said hour wheel, each of said third wheel, fourth wheel, fifth wheel and said rotor pinion rotatable borne between said main plate and said train wheel bridge.

14. The quartz crystal wristwatch of claim 11, wherein said setting gear train includes an intermediate minute wheel and a setting wheel having a setting wheel gear, said intermediate minute wheel pinion engaged to said minute wheel gear, said setting wheel gear selectively and operatively engagable with said winding stem, said setting wheel, intermediate minute wheel and minute wheel pivotably borne between said additional train wheel bridge and said main plate.

15. The quartz crystal wristwatch of claims 1 or 12, wherein said setting assembly includes a pivotable setting lever in engagement with said winding stem for pivoting between a normal time displaying condition and a time setting condition and a yoke pivotably mounted to said support plate and said setting lever for operatively engaging said winding stem to said setting gear train when said setting lever is displaced to said setting position.

16. The quartz crystal wristwatch of claim 1, wherein said setting assembly further includes a clutch wheel slideably mounted on said winding stem and engaged by said yoke, said clutch wheel displaceable from a first normal time displaying position to a second engaged setting position by the engagement with said yoke.

17. The quartz crystal wristwatch of claim 14, wherein said clutch wheel is brought into engagement with said setting wheel when said yoke displaces said clutch wheel into engagement in response to pulling out of said winding stem.

18. The quartz crystal wristwatch of claim 13, wherein said setting assembly further includes a yoke cover mounted to said support plate for biasing said yoke and said setting lever towards said support plate.

19. The quartz crystal wristwatch of claim 13, wherein said setting assembly further includes a second-setting member for engaging said time displaying gear train and said circuit means in response to pulling out of the winding stem for setting the wristwatch.

20. The quartz crystal wristwatch of claim 1, further including a center wheel bridge fixed to said support plate for supporting said time displaying gear train and a pillar-shaped member having a tubular portion substantially perpendicular to a disc-shaped portion having an opening through the tubular region and disc region, said disc region mounted in said center wheel bridge for supporting a cannon pinion which penetrates the support plate.

21. The quartz crystal wristwatch of claim 3, wherein said terminal means include a deformable circuit substrate having a metallic circuit pattern disposed thereon and an adjacent lead plate formed from a substantially rigid material formed with a curved region for biasing said circuit substrate against said member to be contacted.

* * * * *